US012691362B2

(12) United States Patent
Ho et al.

(10) Patent No.: US 12,691,362 B2
(45) Date of Patent: Jul. 28, 2026

(54) OUTDOOR COURT LINE ASSEMBLY

(71) Applicant: Guolai Dong Guan City Plastics And Manufacture Co., Ltd., DongGuan (CN)

(72) Inventors: Yuemei Ho, Taiwan (CN); Hao Tang, DongGuan (CN); Xucong Huang, DongGuan (CN)

(73) Assignee: Guolai Dong Guan City Plastics And Manufacture Co., Ltd., DongGuan City (CN)

( * ) Notice: Subject to any disclaimer, the term of this patent is extended or adjusted under 35 U.S.C. 154(b) by 200 days.

(21) Appl. No.: 18/801,084

(22) Filed: Aug. 12, 2024

(65) Prior Publication Data

US 2024/0399238 A1 Dec. 5, 2024

(30) Foreign Application Priority Data

Apr. 25, 2024 (CN) ..... 202420883226.X

(51) Int. Cl.
*A63C 19/06* (2006.01)

(52) U.S. Cl.
CPC ..... *A63C 19/065* (2013.01); *A63B 2209/08* (2013.01)

(58) Field of Classification Search
CPC ..... A63C 19/06; A63C 19/065; A63C 19/08
See application file for complete search history.

(56) References Cited

FOREIGN PATENT DOCUMENTS

| | | |
|---|---|---|
| CN | 205031871 U | 2/2016 |
| CN | 209155071 U | 7/2019 |

*Primary Examiner* — Brian O Peters

(57) ABSTRACT

An outdoor court line assembly includes a plurality of first court lines and a plurality of connecting edges. Each connecting edge is configured to connect two adjacent first court lines. The first court line includes a main body, a connecting seat connected to an end of the main body, and a first magnetic snap provided at the connecting seat. The first magnetic snap includes a first shell body and a first magnet inside the first shell body. The connecting edge includes a main body and two second magnetic snaps provided at two ends of the main body. The second magnetic snap includes a second shell body and a second magnet provided inside the second shell body. The second magnet is magnetically opposite to the first magnet.

10 Claims, 5 Drawing Sheets

OUTDOOR COURT LINE ASSEMBLY

CROSS-REFERENCE TO RELATED APPLICATIONS

This application claims the benefit of priority from Chinese Patent Application No. 202420883226.X, filed on Apr. 25, 2024. The content of the aforementioned application, including any intervening amendments thereto, is incorporated herein by reference in its entirety.

TECHNICAL FIELD

This application relates to outdoor facilities, more particularly to an outdoor court line assembly.

BACKGROUND

Outdoor sports have been emerging in China in recent years. More and more individuals or families have actively participated in outdoor sports for getting close to the nature. For some outdoor sports (such as badminton and pickleball) with requirements for the court dimension and layout, users can only use chalk or pull lines (such as marking lines) to temporarily create a playing court. However, the chalk is not suitable for some sites (e.g. grassland), and the marked line is not easy to clean up; and the pull lines are prone to deformation, affecting the user experience.

SUMMARY

In view of the deficiencies in the prior art, this application provides an outdoor court line.

Technical solutions of this application are described as follows.

This application provides an outdoor court line assembly, comprising:

a plurality of first court lines; and a plurality of connecting edges;

wherein each of the plurality of connecting edges is configured to connect two adjacent first court lines among the plurality of first court lines;

each of the plurality of first court lines comprises a first main body, a connecting seat connected to an end of the first main body, and a first magnetic snap arranged at the connecting seat;

the first magnetic snap comprises a first shell body and a first magnet provided inside the first shell body;

each of the plurality of connecting edges comprises a second main body and two second magnetic snaps; and the two second magnetic snaps are provided at two ends of the second main body; and each of the two second magnetic snaps comprises a second shell body and a second magnet provided inside the second shell body; and the second magnet is magnetically opposite to the first magnet.

In an embodiment, the connecting seat is provided with a first connecting surface and a second connecting surface; a first mounting slot is provided on the first connecting surface; a fixing slot is provided in the second connecting surface; a plurality of fixing portions are provided at a bottom of the fixing slot for fixing the first magnetic snap; and an end of the first main body is mounted in the first mounting slot.

In an embodiment, a central part of the first shell body is concave inwardly to form a second mounting slot; the first shell body is provided with a function part connected to a bottom of the second mounting slot; and the first magnet is provided inside the function part.

In an embodiment, the first shell body is provided with a plurality of limit slots; the first magnetic snap is provided with a snap portion inside in each of the plurality of limit slots; two ends of the snap portion are connected to a wall of the fixing slot; and the snap portion is in snap fit with the plurality of fixing portions.

In an embodiment, two ends of the second main body are each provided with a fixing slot; each of the plurality of connecting edges is provided with a plurality of fixing portions; and the plurality of fixing portions are provided at a bottom of the fixing slot for fixing each of the two second magnetic snaps.

In an embodiment, a central part of the second shell body is concave inwardly to form a mounting slot; the second shell body is provided with a function part connected to a bottom of the mounting slot; and the second magnet is provided inside the function part.

In an embodiment, the second shell body is provided with a plurality of limit slots; the second magnetic snap is provided with a snap portion inside each of the plurality of limit slots; two ends of the snap portion are connected to a slot wall of the fixing slot; and the second snap portion is in snap fit with the plurality of fixing portions.

In an embodiment, the first main body is made of fabric, thermoplastic elastomer (TPE), or silicone.

In an embodiment, the outdoor court line assembly further comprises a plurality of second court lines; wherein an end of each of the plurality of second court lines is connected to one of the plurality of first court lines or another one of the plurality of second court lines.

In an embodiment, a connection between two second court lines among the plurality of second court lines or between one of the plurality of first court lines and one of the plurality of second court lines is provided with a Velcro tape structure or a magnetic fastening structure.

This application has the following benefits.

A plurality of first court lines and a plurality of connecting edges are arranged, first magnetic snaps are disposed at an end of the first court line, and second magnetic snaps are disposed at the ends of the connecting edge. When in use, the second magnetic snap at the end of the connecting edge is magnetically fixed to the first magnetic snap at the end of the first court line through the cooperation of the first magnet and the second magnet. The second magnetic snap on the other end of the connecting edge is magnetically fixed to the first magnetic snap on the end of another first court line. Thus, two adjacent first court lines can be connected by one connecting edge to form a whole. According to the rules of the game or sport, the outdoor sport area is rapidly demarcated. After use, the outdoor court line assembly can be quickly gathered and recycled, and thus it has strong practicability, and is suitable for promotion.

DETAILED DESCRIPTION OF EMBODIMENTS

Figure 1:
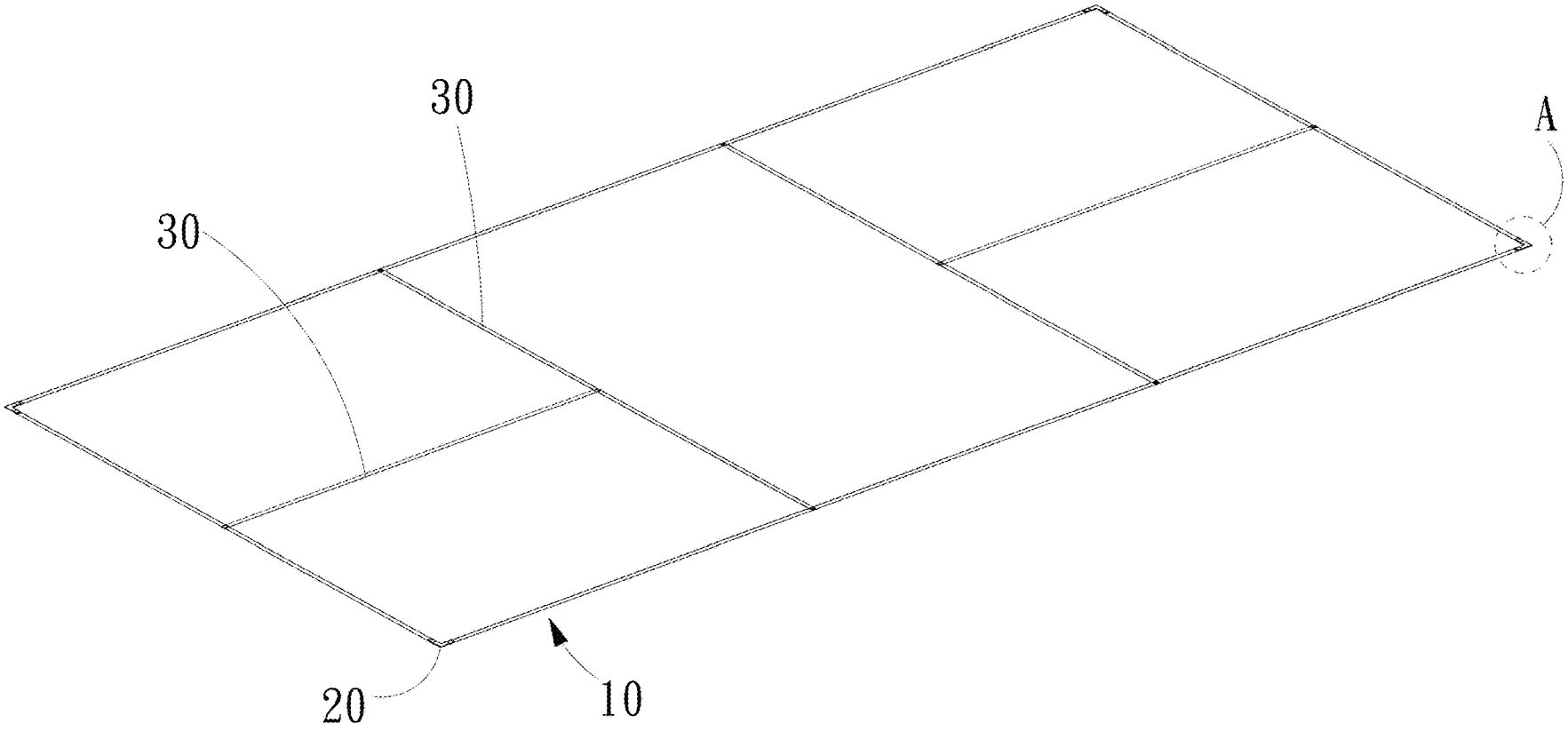
FIG. 1 schematically shows a structure of an outdoor court line assembly according to an embodiment of the present disclosure.
Figure 2:
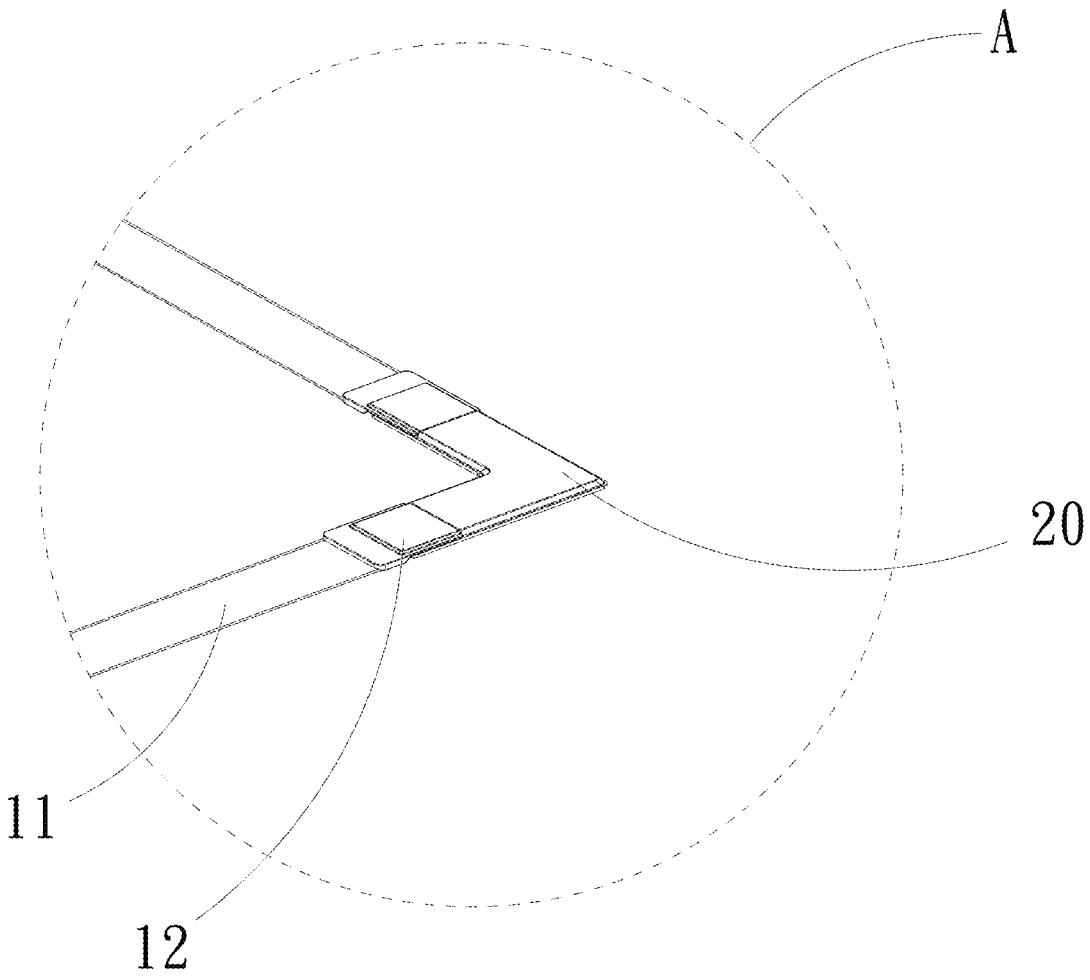
FIG. 2 is an enlarged view of part "A" in FIG. 1.
Figure 3:
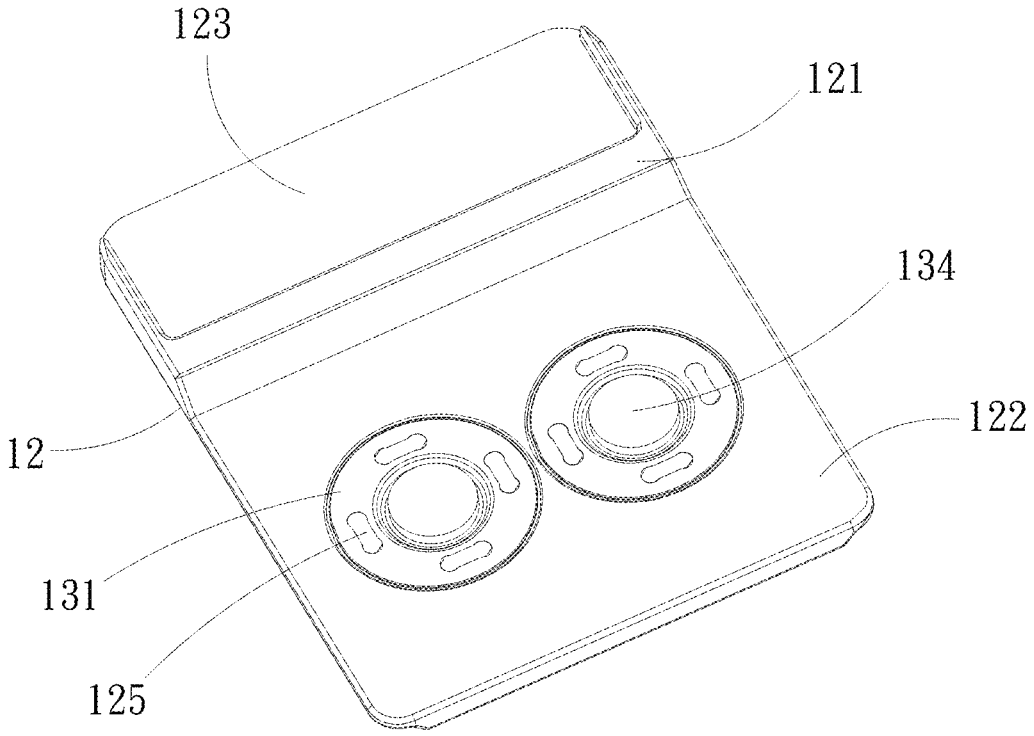
FIG. 3 schematically shows that a connection seat is installed in conjunction with a first magnetic snap.
Figure 4:
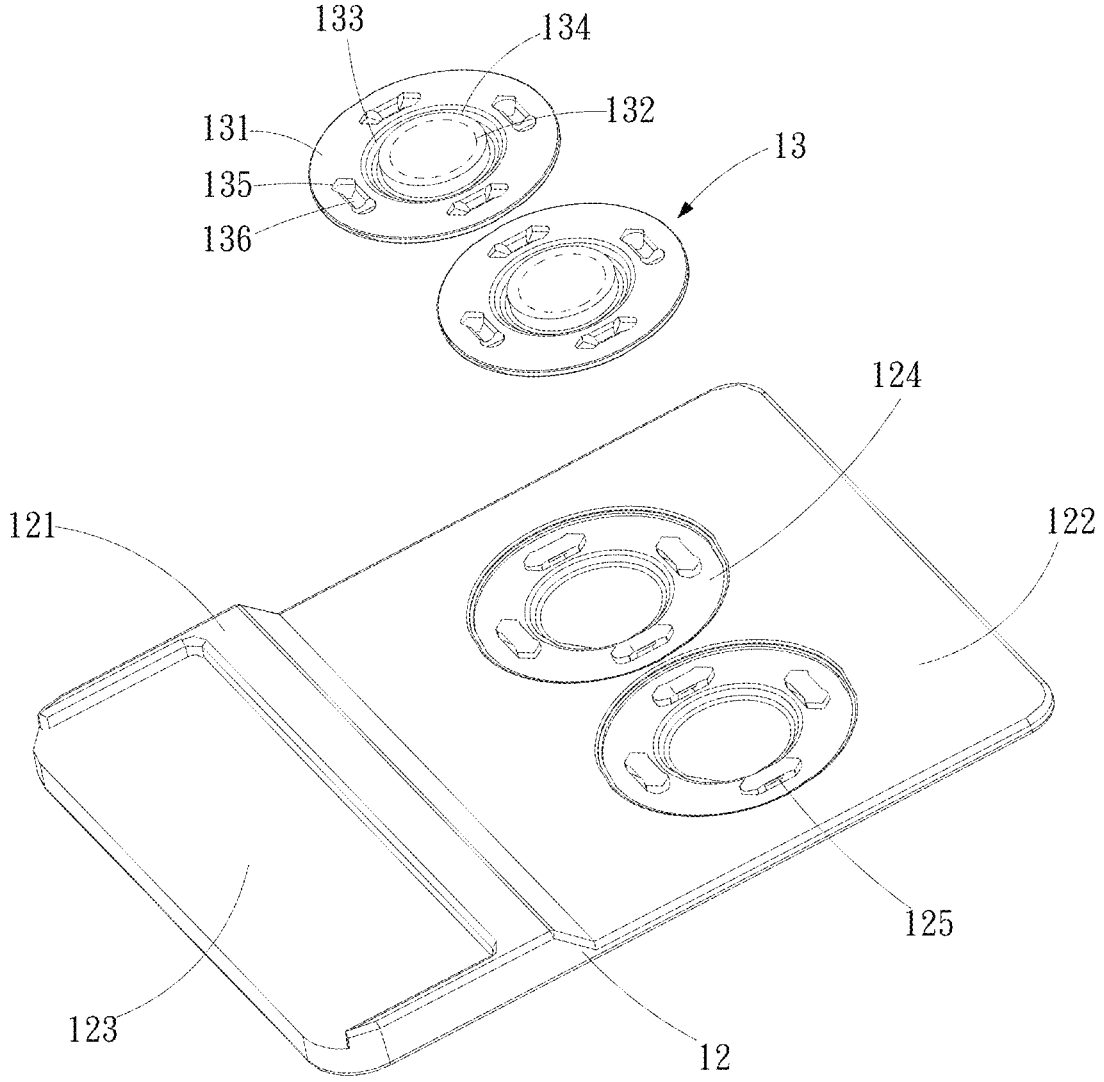
FIG. 4 is an exploded view of a first court line in the absence of a main body.
Figure 5:
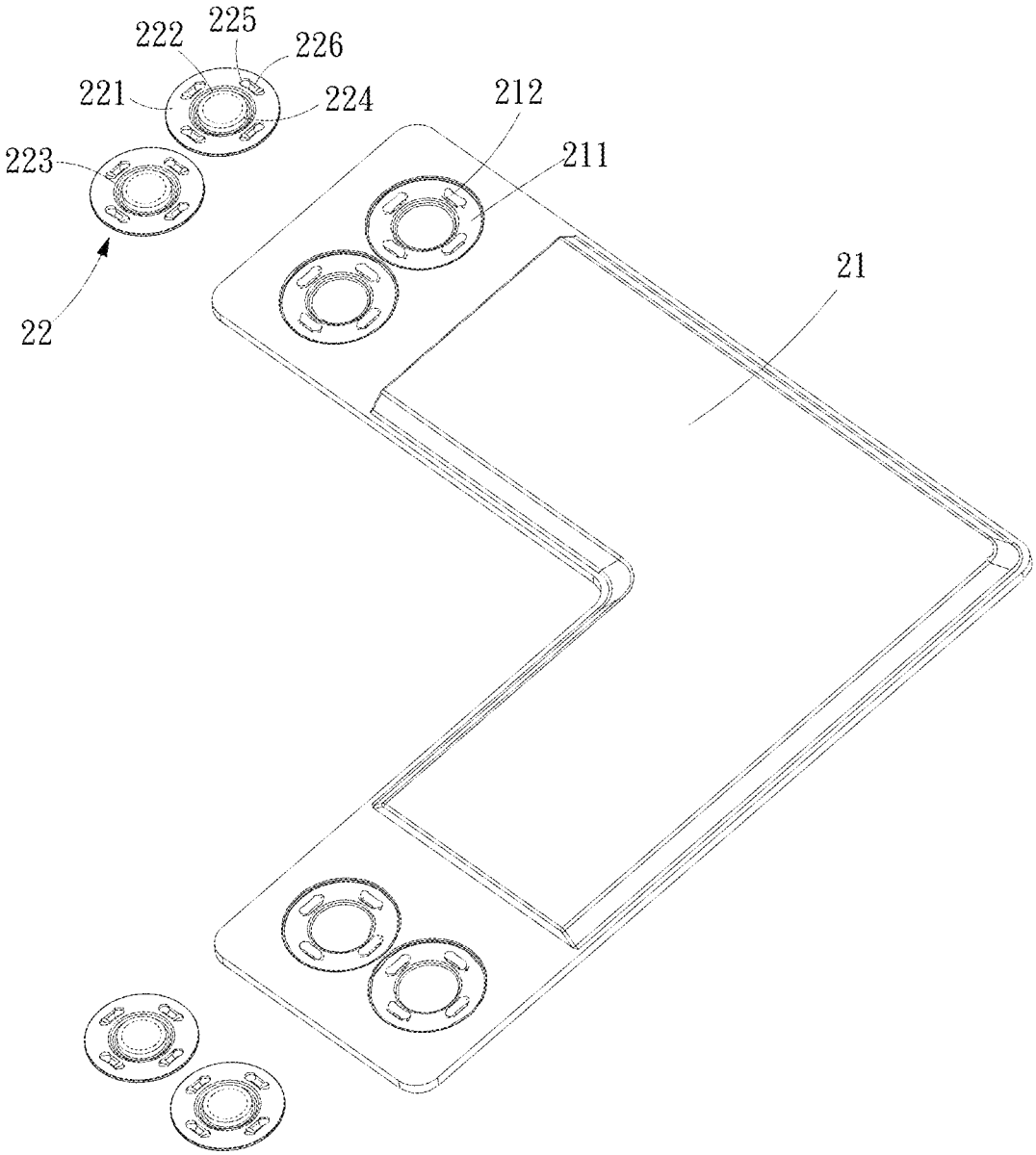
FIG. 5 is an exploded view of a connecting edge.

The present disclosure will be further described in detail below in conjunction with the accompanying drawings and embodiments to understand the above objects, features and advantages of the present disclosure more clearly. Many details are described below to facilitate the understanding of the present disclosure. However, the present disclosure may also be implemented in other ways different from those described herein. Therefore, the scope of the disclosure is not limited by the embodiments disclosed below.

As used herein, it should be noted that the orientation or positional relationship indicated by the terms "center", "longitudinal", "lateral", "length", "width", "thickness", "upper", "lower", "front", "back", "left", "right", "vertical", "horizontal", "top", "bottom", "inside", "outer", "clockwise", "counterclockwise", "axial", "radial", "circumferential" is based on the orientation or positional relationship shown in the accompanying drawings, or the orientation or positional relationship commonly placed when the product of the disclosure is used, which is only for the convenience of describing the technical solutions and simplifying the description, rather than indicating or implying that the indicated device or element must have a specific orientation, be constructed or operated in a specific orientation. Therefore, these terms should not be understood as a limitation of the present disclosure.

In addition, the terms "first" and "second" are merely descriptive, and cannot be understood as indicating or implying relative importance or implicitly specifying the number of technical features indicated. Thus, a feature defined with "first", "second" may include at least one such feature, either explicitly or implicitly. The term "plurality" means at least two, e.g., two or three, unless otherwise expressly and specifically limited.

As used herein, unless otherwise expressly specified and defined, the terms, such as "fix", "mount", and "connect" should be understood in a broad sense, for example, it may be fixed connection, detachable connection, or integral connection; it may be a mechanical connection or an electrical connection; it may be direct connection or indirect connection through an intermediate medium; and it may be an internal communication between two member or an interaction between the two elements unless otherwise expressly defined and limited. For those skilled in the art, the specific meanings of the above terms can be understood according to specific situations.

As used herein, unless otherwise expressly specified and defined, the terms, such as "above" or "below" indicate that a second feature may be a direct contact with a second feature, or an indirect contact between the first and second features through an intermediate medium. In addition, the first feature being "above", "on" and "over" the second feature may be that the first feature is directly above or diagonally above the second feature, or simply that the first feature is horizontally higher than the second feature. The first feature being "below", "under" and "underneath" the second feature may be that the first feature is directly below or diagonally below the second feature, or simply that the first feature is less horizontally than the second feature.

It should be noted that when an element is said to be "fixed to" or "disposed on" another element, it may be directly on another element or there may be an intermediate element. When an element is said to be "connected" to another element, it may be directly attached to another element or there may be intermediate element. As used herein, the terms "vertical", "horizontal", "top", "bottom", "left", "right", are used herein for illustrative purposes only and do not indicate a unique implementation.

Referring to FIGS. 1 to 5, an outdoor court line assembly herein provided is used to construct a demarcated area for outdoor sports or outdoor games according to the rules of the games or sports. The outdoor court line assembly includes a plurality of first court lines 10 and a plurality of connecting edges 20. Each of a plurality of connecting edges 20 are used to connect two adjacent first court lines 10 among a plurality of first court lines.

Each of a plurality of first court lines 10 includes a first main body 11, a connecting seat 12 connected to one end of the first main body 11, and a first magnetic snap 13 fitted to the connecting seat 12. The first main body 11 is in the shape of a flat elongate strip, which can be curled or folded for easy storage. The first main body 11 is made of fabric, thermoplastic elastomer (TPE), or silicone. Preferably, the material of the first main body 11 is silicone.

The connection seat 12 is provided with a first connecting surface 121 and a second connecting surface 122 at a side surface. The first connecting surface 121 and the second connecting surface 122 are distributed in a step-like manner. The depth of the second connecting surface 122 in the connection seat 12 is greater than that of the first connecting surface 121. The connection seat 12 is provided with a first mounting slot 123 on the first connecting surface 121. The second connecting surface 122 is provided with a first fixing slot 124. The connection seat 12 is provided with a plurality of first fixing portions 125 at the bottom of the first fixing slot 124. The first fixing portions 125 are used for fixing the first magnetic snap 13. The first fixing portions 125 are connected to the bottom of the first fixing slot 124 by secondary molding.

The first magnetic snap 13 includes a first shell body 131 and a first magnet 132 set inside the first shell body 131. A central part of the first shell body 131 is concave inwardly to form a second mounting slot 133. The first shell body 131 is provided with a first function part 134 connected to the bottom of the second mounting slot 133. The first magnet 132 is set inside the first function part 134. The first shell body 131 is provided with a plurality of first limit slots 135 around the first function part 134. The first magnetic snap 13 is provided with a first snap portion 136 inside each first limit slot 135. Both ends of the first snap portion 136 are connected to the slot wall of the first fixing slot 124.

During the assembly, the first shell body 131 of the first magnetic snap 13 is disposed in the first fixing slot 124, and glue is injected into the first limit slot 135 of the first magnetic snap 13. After cooling, the first fixing portion 125 is formed, and the first snap portion 136 is in snap fit with the first fixing portion 125. The end portion of the first main body 11 is fitted into the first mounting slot 123 by means of glue, rivets, or other means.

In this embodiment, each of a plurality of connecting edges 20 includes a second main body 21 and two second magnetic snaps 22. The two second magnetic snaps 22 are separately mounted at the ends of the second main body 21. The second main body 21 is set in an L-shape. Two ends of the second main body 21 are each provided with a second fixing slot 211. Each of a plurality of connecting edges 20 is provided with a plurality of second fixing portions 212. A plurality of second fixing portions 212 are provided at the bottom of the second fixing slot 211. The second fixing portions 212 are used to fix each of the two second magnetic snaps 22. The second fixing portion 212 is connected to the bottom of the second fixing slot 211 by secondary molding.

Each of the two second magnetic snaps 22 includes a second shell body 221 and a second magnet 222 provided inside the second shell body 221. The second magnet 222 is magnetically opposite to the first magnet 132. The second shell body 221 is concave inwardly in the middle to form a third mounting slot 223. The second shell body 221 is provided with a second function part 224 connected to the bottom of the third mounting slot 223. The second magnet 222 is provided inside the second function part 224. The second shell body 221 is provided with a plurality of second limit slots 225 around the second function part 224. The second magnetic snap 22 is provided with a second snap portion 226 inside each of a plurality of second limit slot 225. Two ends of the second snap portion 226 are connected to the slot wall of the second fixing slot 211.

When assembled, the second shell body 221 of the second magnetic snap 22 is set in the second fixing slot 211. Glue is injected into the second limit slot 225 of the second magnetic snap 22. After cooling, the second fixing portion 212 is formed, and the second snap portion 226 is in snap fit with the second fixing portion 212.

In use, two adjacent first court lines 10 may be connected by one connecting edge 20 to form a whole. Specifically, the second magnetic snap 22 on one side of the connecting edge 20 is magnetically fixed to the first magnetic snap 13 at one end of the first court line 10 through the cooperation of the first magnet 132 and the second magnet 222. The second magnetic snap 22 on the other side of the connecting edge 20 is magnetically fixed to the first magnetic snap 13 at one end of the other first court line 10.

The outdoor court line assembly further includes a plurality of second court lines 30. An end of each of a plurality of second court lines 30 is connected to one of a plurality of first court line 10 or another one of a plurality of second court lines 30. A connection between two second court lines 30 among a plurality of second court lines 30 or between one of a plurality of first court lines 10 and one of a plurality of second court lines 30 is provided with a Velcro tape structure or a magnetic fastening structure.

This disclosure will be described in detail in conjunction with practical applications. The outdoor court line assembly is used to demarcate a pickleball court as shown in FIG. 1. The outdoor court line assembly includes four first court lines 10, two sets of second court lines 30, and four connecting edges 20. The connecting edges 20 are set in an L-shape. The four first court lines 10 are distributed in an in a rectangle. Two neighboring first court lines 10 are connected by one connecting edge 20. Each set of the second court lines 30 includes a transverse second court line 30 and a longitudinal second court line 30. A Velcro structure is provided at the connection position of the first court line 10 and the second court line 30. The transverse second court line 30 is transversely connected to the two first court lines 10 through the Velcro structures. The longitudinal second court line 30 is longitudinally connected to the transverse second court line 30 and the and another first court line 10.

The outdoor court line assembly provide herein has the following benefits. A plurality of first court lines 10 and a plurality of connecting edges 20 are arranged, the end of the first court line 10 is provided with the first magnetic snap 13, and the end of the connecting edge 20 is provided with the second magnetic snap 22. When in use, the second magnetic snap 22 at the end of the connecting edge 20 is magnetically fixed to the first magnetic snap 13 at the end of the first court line 10 through the cooperation of the first magnet 132 and the second magnet 222. The second magnetic snap 22 at the other end of the connecting edge 20 is fixed magnetically with the first magnetic snap 13 at the end of the other first court line 10, so that two adjacent first court lines 10 can be connected through the connecting edge 20 to form a whole. According to the rules of the game or sport, the outdoor sport area is rapidly demarcated. After use, the outdoor court line assembly can be recycled and reused quickly, which is practical and propagable.

It should be noted that embodiments of the present disclosure and the features therein may be combined with each other in the case of no contradiction. Described above are merely some embodiments of the disclosure, which are not intended to limit the disclosure. Any modifications and replacements made by those skilled in the art without departing from the spirit of the disclosure should fall within the scope of the disclosure defined by the appended claims.

What is claimed is:

1. An outdoor court line assembly, comprising:

a plurality of first court lines; and a plurality of connecting edges;

wherein each of the plurality of connecting edges is configured to connect two adjacent first court lines among the plurality of first court lines;

each of the plurality of first court lines comprises a first main body, a connecting seat connected to an end of the first main body, and a first magnetic snap arranged at the connecting seat;

the first magnetic snap comprises a first shell body and a first magnet provided inside the first shell body;

each of the plurality of connecting edges comprises a second main body and two second magnetic snaps; and the two second magnetic snaps are provided at two ends of the second main body; and each of the two second magnetic snaps comprises a second shell body and a second magnet provided inside the second shell body; and the second magnet is magnetically opposite to the first magnet.

2. The outdoor court line assembly of claim 1, wherein the connecting seat is provided with a first connecting surface and a second connecting surface; a first mounting slot is provided on the first connecting surface; a fixing slot is provided in the second connecting surface; a plurality of fixing portions are provided at a bottom of the fixing slot for fixing the first magnetic snap; and an end of the first main body is mounted in the first mounting slot.

3. The outdoor court line assembly of claim 2, wherein a central part of the first shell body is concave inwardly to form a second mounting slot; the first shell body is provided with a function part connected to a bottom of the second mounting slot; and the first magnet is provided inside the function part.

4. The outdoor court line assembly of claim 2, wherein the first shell body is provided with a plurality of limit slots; the first magnetic snap is provided with a snap portion inside in each of the plurality of limit slots; two ends of the snap portion are connected to a wall of the fixing slot; and the snap portion is in snap fit with the plurality of fixing portions.

5. The outdoor court line assembly of claim 1, wherein two ends of the second main body are each provided with a fixing slot; each of the plurality of connecting edges is provided with a plurality of fixing portions; and the plurality of fixing portions are provided at a bottom of the fixing slot for fixing each of the two second magnetic snaps.

6. The outdoor court line assembly of claim 5, wherein a central part of the second shell body is concave inwardly to form a mounting slot; the second shell body is provided with a function part connected to a bottom of the mounting slot; and the second magnet is provided inside the function part.

7. The outdoor court line assembly of claim 5, wherein the second shell body is provided with a plurality of limit slots; the second magnetic snap is provided with a snap portion inside each of the plurality of limit slots; two ends of the snap portion are connected to a slot wall of the fixing slot; and the second snap portion is in snap fit with the plurality of fixing portions.

8. The outdoor court line assembly of claim 1, wherein the first main body is made of fabric, thermoplastic elastomer (TPE), or silicone.

9. The outdoor court line assembly of claim 1, further comprising:

a plurality of second court lines;

wherein an end of each of the plurality of second court lines is connected to one of the plurality of first court lines or another one of the plurality of second court lines.

10. The outdoor court line assembly of claim 9, wherein a connection between two second court lines among the plurality of second court lines or between one of the plurality of first court lines and one of the plurality of second court lines is provided with a Velcro tape structure or a magnetic fastening structure.

* * * * *